United States Patent [19]

Kinzalow et al.

[11] Patent Number: 4,789,361

[45] Date of Patent: Dec. 6, 1988

[54] FUSED CIGARETTE LIGHTER RECEPTACLE AND ADAPTOR PLUG ASSEMBLIES

[75] Inventors: Richard L. Kinzalow; Richard M. Kinzalow, both of Park Ridge, Ill.

[73] Assignee: Kinzalow Properties - Leasing, Wheaton, Ill.

[21] Appl. No.: 86,284

[22] Filed: Aug. 17, 1987

[51] Int. Cl.[4] ..... H01R 13/68

[52] U.S. Cl. ..... 439/622; 337/209

[58] Field of Search ..... 337/198, 209; 439/621, 439/622; 219/260, 262–264, 267

[56] References Cited

U.S. PATENT DOCUMENTS

| | | | |
|---|---|---|---|
| 2,257,608 | 9/1941 | Keefe | 337/198 |
| 3,377,610 | 4/1968 | Busch et al. | 439/441 |
| 3,876,273 | 4/1975 | Schwartz | 439/148 |
| 4,309,069 | 1/1982 | Ahroni | 439/622 |
| 4,322,122 | 3/1982 | Schwartz et al. | 439/621 |
| 4,391,485 | 2/1983 | Urani | 439/621 |
| 4,560,227 | 12/1985 | Bukala | 439/621 |
| 4,575,704 | 3/1986 | Pezold | 439/622 |

*Primary Examiner*—Gil Weidenfeld
*Assistant Examiner*—Gary F. Paumen
*Attorney, Agent, or Firm*—McCaleb, Lucas & Brugman

[57] ABSTRACT

Improved automobile cigarette lighter male accessory adaptor plug and female receptacle connector assemblies are disclosed whereby a vehicle's electrical system is adapted to operate a variety of remote electrical devices and appliances. Both the male plug and female receptacle are constructed as unitary connector assemblies incorporating in-line fuse holders receptive of miniature, generally flat, insert type fuses having visable fuse links and extending blade terminals; the fuse being openingly accessible at the exterior of the connector assembly whereby the same is air cooled and is readily visable and removeable for inspection or replacement without disassembly of the connector.

10 Claims, 3 Drawing Sheets

FIG. 1
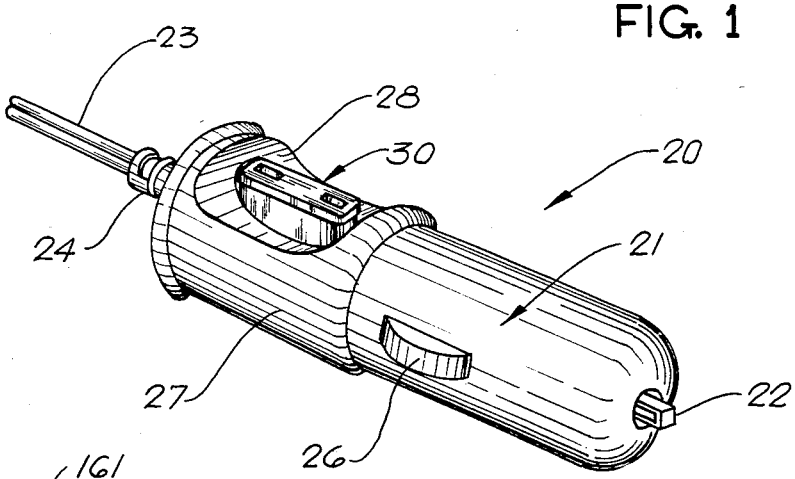
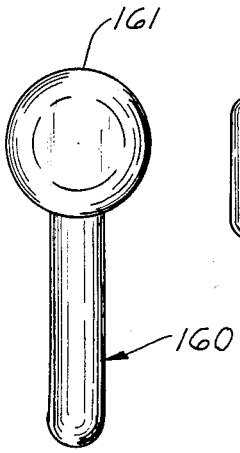
FIG. 11
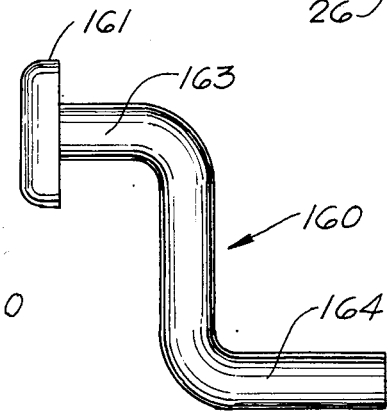
FIG. 12
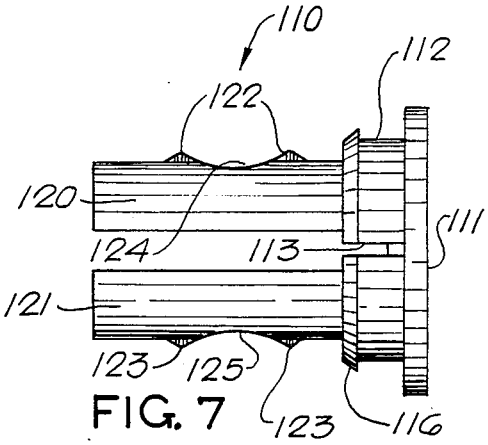
FIG. 7
FIG.13
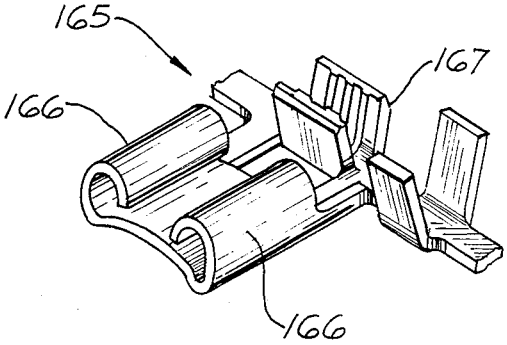
PRIOR ART
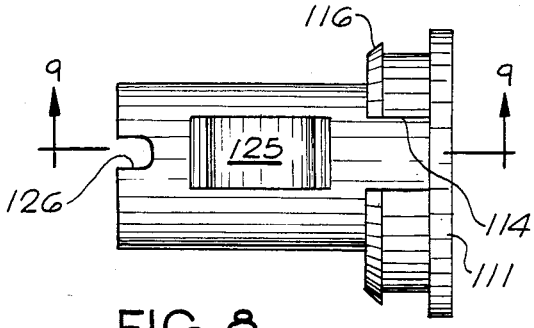
FIG. 8
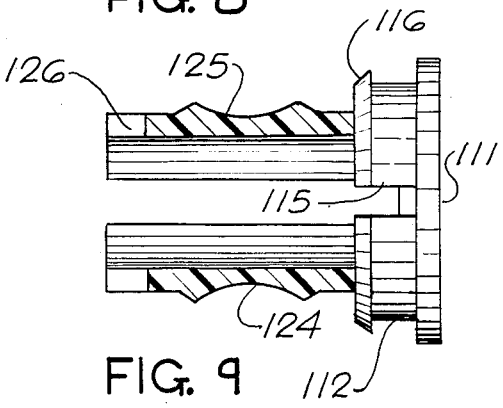
FIG. 9

FUSED CIGARETTE LIGHTER RECEPTACLE AND ADAPTOR PLUG ASSEMBLIES

This invention relates generally to electrical connectors and more particularly to improved vehicle cigarette lighter receptacle and adaptor plug assemblies.

Electrical connectors incorporating circuit protective fuses including adaptor plugs insertable into the familiar automobile cigarette lighter outlet or receptacle to energize a variety of remote electrical devices such as electric shavers, vacuum sweepers, trouble lights and the like are known in the art. One such device is described in U.S. Pat. No. 4,322,122 issued Mar. 30, 1982. As therein disclosed an adaptor plug for use with a cigarette lighter receptacle employs the familiar glass cylinder, 3 AG type automotive fuse mounted within the adaptor plug body. One end of the fuse projects outwardly of the plug body to serve as a positive circuit contact engageable with an electrical contact of the cigarette lighter receptacle. In the event of fuse blowout, disassembly of the adaptor plug is required for replacement and inspection of the fuse. Other known fused adaptor plugs similarly utilize the cylindrical type fuse located within the body of the adaptor plug.

All such known fused adaptor plug assemblies suffer from the common problem of heat build-up, particularly at high current levels of 10–15 amps or more. Since the fuse is enclosed within the adaptor plug body and is further enclosed within the lighter receptacle when in use, heat is trapped about the fuse. This coupled with the resistance of poor mechanical electrical contacts plus the resistance of the fuse itself serves to add to the heat build-up problem which seriously impairs the operating characteristics of the fuse in its circuit protective function.

Most known plug adaptors, fused or unfused, further are deficient since they fail to isolate internal circuit components from external forces exerted on the electrical conductor leading from the adaptor plug to the device being energized. This can result in disruption of the circuit and attendant fire hazzard. In addition, by and large previously known adaptor plugs encounter difficulty in mating with standard cigarette lighter receptacles, which vary in diameter depending on the source of manufacture. For example, the standard U.S. size has an internal diameter of approximately 0.82 inches while the standard European size has an internal diameter of approximately 0.87 inches. Adaptor plugs that mat well with the U.S. size typically mate poorly with the European size.

Known cigarette lighter receptacles and similar female connector assemblies, do not incorporate protective fuses. Consequently, if the previously known receptacles are used with an unfused adaptor plug, the appliance being energized is unprotected.

Thus there is a need for improved connector assemblies to avoid the aforenoted difficulties. It is to this endeavor that the present invention is addressed.

SUMMARY OF THE INVENTION

In brief the present invention is directed to improved fuse protected electrical connectors, particularly an adaptor plug, for use with the familiar cigarette lighter receptacle. In an alternate embodiment of this invention the fused assembly is embodied in an improved female receptacle. In both instances an insert type, relatively flat, transparent, usually plastic encased fuse employing a pair of extending blade contacts having a fuse link therebetween is employed. The fuse is arranged for insertion and removal from the exterior of the adaptor plug or receptacle body and is readily visable to the user for visual inspection without removal from the assembly. In the event, the fuse is damaged or blown, such may be readily removed and replaced. Due to this external arrangement, the fuse is generally open to the atmosphere and cooled thereby as are the electrical connector terminals of the plug or receptacle into which the fuse is inserted. Consequently, the problem of heat build-up about the fuse is minimized. Both the plug and receptacle assemblies are enclosed by unified, electrically insulated bodies to present a rugged integrated structure which is not designed to be taken apart and which incorporate means for isolating internal electrical components thereof from external forces, such as pulling forces applied to an electrical conductor coupled thereto.

One of the principle objects of this invention is to provide improved fuse protected electrical connector assemblies particularly useful for automotive vehicle cigarette lighters and the like.

It is a further object of this invention to provide improved receptacle and adaptor plug assemblies for use in automotive vehicle cigarette lighters and the like which comprise insert type fuses that are mounted for visual inspection and ready insertion or removal from the exterior of the connector assembly.

Still another object of this invention is to provide improved receptacle and adaptor plug assemblies comprising flat, insert type, circuit protective fuses which are air cooled by the atmosphere about the exterior of the receptacle or adaptor plug body.

Still another object of this invention is to provide an improved connector assembly, particularly useful for female receptacles and male adaptor plugs which has improved features of construction, use and operational characteristics.

A further object of this invention is to provide an improved adaptor plug assembly, particularly useful with automotive vehicle cigarette lighter receptacles, which has features of construction and arrangement adapting the same for use with receptacles of different internal diameters.

Having described this invention, the above and further objects, features and advantages thereof will appear from the following detailed description of preferred and modified embodiments thereof, illustrated in the accompanying drawings and representing the best mode presently contemplated for enabling those skilled in the art to make and practice this invention.

IN THE DRAWINGS

FIG. 1 is a perspective view of a male adaptor plug assembly according to this invention;

FIG. 7 is a top plan view of a molded cap member inserted into one end of the body illustrated in FIGS. 5 and 6;

FIG. 8 is a side elevation the cap member shown in FIG. 7;

FIG. 9 is a partial sectional view, with portions in elevation, taken substantial along vantage line 9—9 of FIG. 8 and looking in the direction of the arrows thereon;

FIG. 11 is a front elevational view of a unitary contact member employed in the assembly of FIG. 10;

FIG. 12 is a side elevational view of the contact member shown in FIG. 11; and

FIG. 13 is a perspective view of a connector terminal employed in the assembly of FIG. 10.

DESCRIPTION OF THE PREFERRED EMBODIMENT

Figure 2:
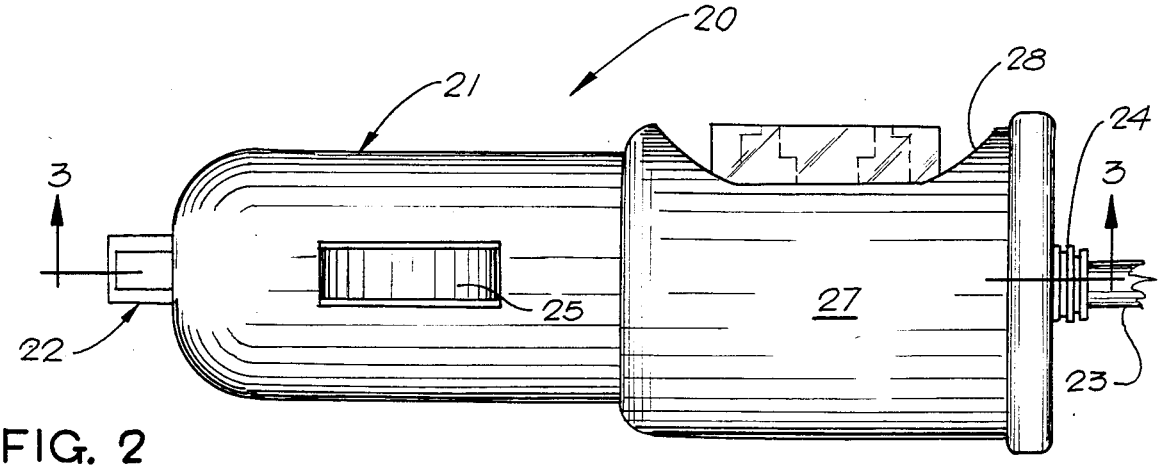
FIG. 2 is a side elevation of the assembly shown in FIG. 1.

Turning now to the particulars of the preferred embodiment illustrated in the accompanying drawings, initial reference is made to FIGS. 1 and 2 from which it will be recognized that the connector assembly 20 therein illustrated comprises a male adaptor plug having a generally cylindrical body 21, a positive contact element 22 extending from one operatively inner end thereof and a multiple wire conductor 23 with molded strain relief 24 extending from the opposite end thereof for joining the plug to a remote electrical appliance (not shown). A negative contact 25, in the form of a arcuately bowed spring, protrudes laterally outwardly of on side of body 21 (see FIG. 2) and a similar arcuately bowed retention spring 26 protrudes from the opposite side of body 21. Both negative contact 25 and retention spring 26 are coplanar with the centrally extending positive contact 22.

Body 21 is formed with an enlarged, cylindrical section 27 adjacent its operationally outer end which is manually engaged when the adaptor plug is inserted or withdrawn from a cooperating receptacle. The upper side of the manually engageable portion 27 is formed with an arcuate depression 28 in which is mounted a generally rectangular shaped, transparent, flat insert type fuse 30 commonly referred to as a ATO fuse. Such fuses are readily available commerically and are widely used in the modern day automotive vehicles, by and large replacing the familiar cylindrical glass 3 AG fuse, referred to heretofore.

While the illustrations of FIGS. 1 and 2 set forth the general features of a male adaptor plug, specific aspects of its construction and assembly will be understood best with reference to FIGS. 3-9 of the drawings.

Figure 4:
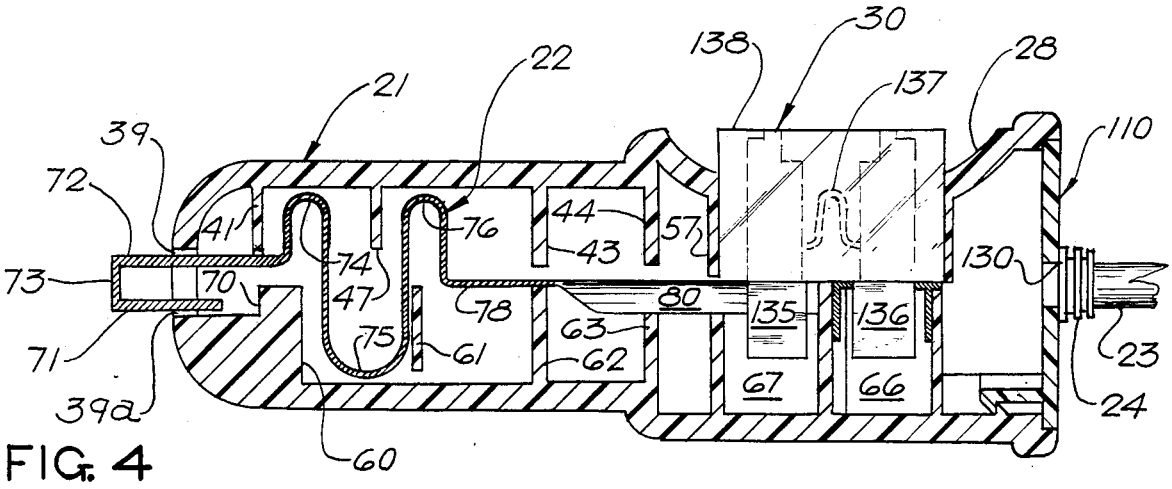
FIG. 4 is a longitudinal cross-sectional view taken along a central vertical plane of the assembly shown in FIGS. 1 and 2.
Figure 5:
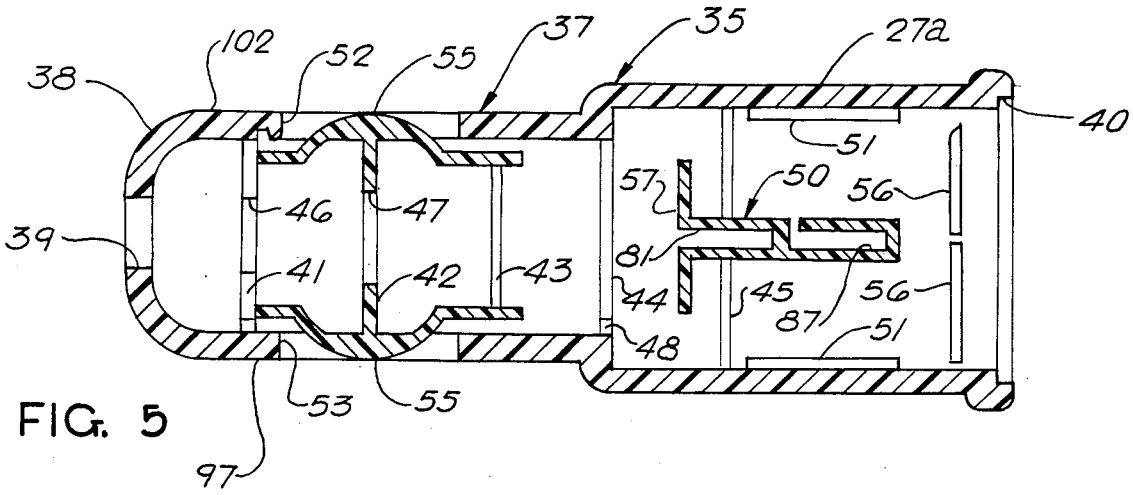
FIG. 5 is a bottom plan view of a upper half shell body portion employed in the assembly shown in FIGS. 1 and 2.
Figure 6:
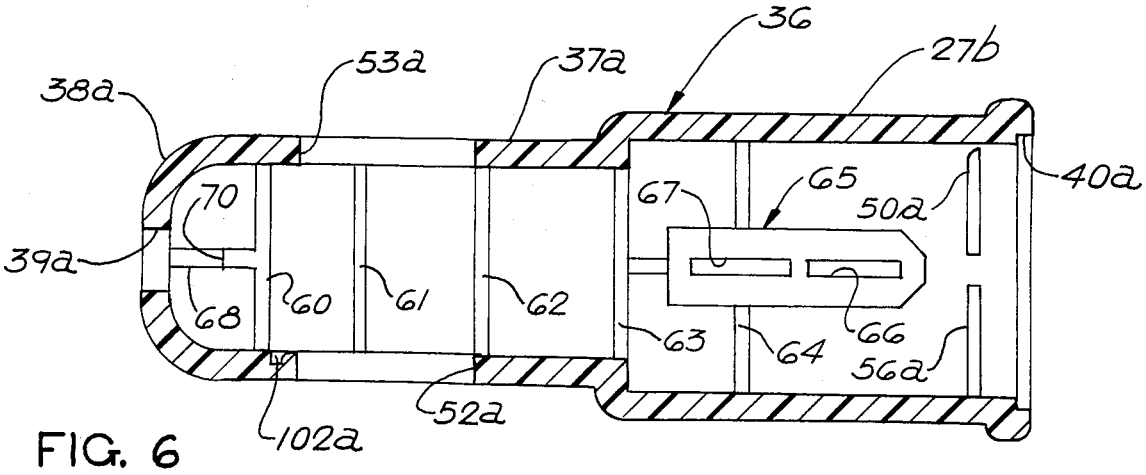
FIG. 6 is a top plan view of a lower half shell portion of the assembly shown in FIG. 1.

As shown in FIGS. 3-6 body 21 of the plug assembly is formulated from a pair of molded halves comprising a male half shell portion 35 (FIG. 5) and a female half shell portion 36 (FIG. 6). The two shell portions are mated together to form the generally cylindrical housing 21 with integral manually engageable handle portion. The half shells are sonically welded or glued together to effect a unified body structure, eliminating the need for any type of extraneous fastening devices therebetween, such as rivets, bolts and nuts or the like. In essence the male shell portion 35 constitutes the upper half of the assembled body, as illustrated in FIGS. 1 and 2, and the female shell portion 36 constitutes the bottom one half thereof. Both of the shell portions 35 and 36 are formulated with a number of internal ribs and walls which, as will appear in greater detail presently, serve to rigidly support the internal current carrying components of the connector assembly in a manner whereby the insert-type fuse 30 is in operational relationship between the energy supplying contacts of the cigarette lighter receptacle and the appliance served over electrical conductor 23. It will be understood, of course, that the various internal components of the assembly are mounted within the two half shells 35 and 36 prior to the welding of such members into a unified structure, thereby encasing the components in a generally permanent unitary housing which is not intended to be disassembled.

As noted heretofore, the housing 21 for the male plug assembly 20 preferrably is molded of high impact styrene, ABS, polyester or similar plastic material and to that end preferrably is formed in two half shell portions 35 and 36 as illustrated in FIGS. 5 and 6 of the drawings. These shell portions, as previsouly noted, intermate and are welded into a unified housing structure.

With particular reference to the male shell portion 35 illustrated in FIG. 5, it will be recognized that the outer wall formation thereof comprises a semi-cylindrical cross-section forming a first larger diametered, manually engageable handle portion 27*a* adjacent the operationally outermost end of the plug assembly and a reduced diameter main body portion 37 extending forwardly from handle portion 27*a* and suitably rounded over at its outer end to provide an enclosing nose portion 38. The nose portion is provided with a central opening 39 for passage of the positive contact element 22 in final assembly. The outer end of the handle portion 27*a* is open as at 40, for purposes which will appear presently. Such general exterior configuration for the male half portion 35 is largely repeated in the female half portion 36 to provide a handle portion 27*b*, a main body portion 37*a*, and enclosing nose portion 38*a* with central opening 39*a*. The handle of the shell portion 36 also is open at 40*a* to provide an open end in the assembled housing.

Internally the male shell portion 35 is provided with a plurality of transversely extending partitions or walls, indicated by numerals 41-45 which generally constitute reinforcing members for strengthening the shell portion 35 transversely of its longitudinal axis. Walls 41, 42, 43, and 44 all terminate inwardly of the parting or mating edge of the shell's exterior wall, with walls 41 and 42 having central passageways or openings 46,47 therein to accomodate passage of the positive contact member 22. Wall 44 likewise is provided with an opening or passage way 48 near one edge thereof for passage of the negative contact member 25 (see FIG. 3).

The partition wall 45 which traverses the handle portion 27*a* of the male shell molding, is interrupted by a centrally disposed labyrinth 50 which lies beneath and openly communicates with the exterior indentation 28 of the housing to provide spaced pockets for the reception of contact blades of fuse 30 along with electrical connective elements of the plug assembly, as will be described hereinafter. Diametrically, opposite the labyrinth 50 on the interior of shell 35 are a pair of opposed pad members 51,51, the purpose of which will be explained in conjunction with the assembly of the electrical components within the male plug.

The smaller diametered semi-cylindrical body portion 37 of the male shell portion 35 is particularily distinguished by a pair of lateral openings 52 and 53 in its opposite sides which are generally rectangular in configuration and are opposite semi-arcuate support portions 55,55 located at opposite ends of the barrier partition 42. Portions 55,55 support the negative contact system of the plug assembly namely, the negative contact member 25 and the cooperating retention spring 26, as shown best in FIG. 3.

The enlarged handle section 27*a* is distinguished by a pair of detent recesses 56,56 formed inwardly of its interior walls adjacent the open end 40, while the labyrinth section 50 is supported by the transverse walls 45 and an additional wall 57, parallel to wall 45, as shown in FIG. 5.

It also is to be noted from FIG. 5 that both the labyrinth 50 and its supporting wall 57 as well as the arcuate shaped spring supports 55,55 and associated wall 42 are shown in section for the reason that such portions of the male half shell extend beyond the parting line or mating edge of its outer housing wall to enter the female half shell portion 36 in assembly.

Turning now to the general features of the female shell portion 36 illustrated in FIG. 6 of the drawings, portions thereof which correspond to those enumerated in conjunction with the description of the male half shell 35 above, have the same numerical designation with a sub letter. As shown, the female shell portion 36 is exteriorly similar in all respects to the male half shell 35 with the exception of the indented recess 28 in the exterior of the male shell, as shown in FIGS. 1, 2, and 4. Interiorly, the female shell portion is traversed by a plurality of internal barrier support walls or partitions 60–64 with the handle section 27*b* thereof having a generally centrally disposed blade receptive socket 65 presenting spaced opening 66 and 67 aligned with the corresponding blade receptive spaces in labyrinth 50 formed in the male shell 35. Locking indentations 56*a*,56*a* are provided in the interior walls of the female shell adjacent the rear opening 40*a* thereof; such indentations 56*a* being aligned with recesses 56,56 for cooperation therewith.

It will be noted that partitions 60 and 61 are not aligned opposite the counter-part partitions 41 and 47 of the male shell and further that the partition 60 is T-shaped and integral with a reinforcing partition 68 extending transversely between partition 60 and the nose wall 38*a* of the female shell. Wall 68 is distinguished by a step down configuration to provide a stop shoulder 70 aligned opposite opening 39*a*. Shoulder 70 acts as a stop means for limiting movement of the positive contact member 22 in operation, as will appear presently. Further, it will be noted that all the interior walls and partitions of the female shell portion lie beneath the central parting line or that is the edge of the female shell which mates with the corresponding outside housing edge of the male shell in assembly.

Figure 3:
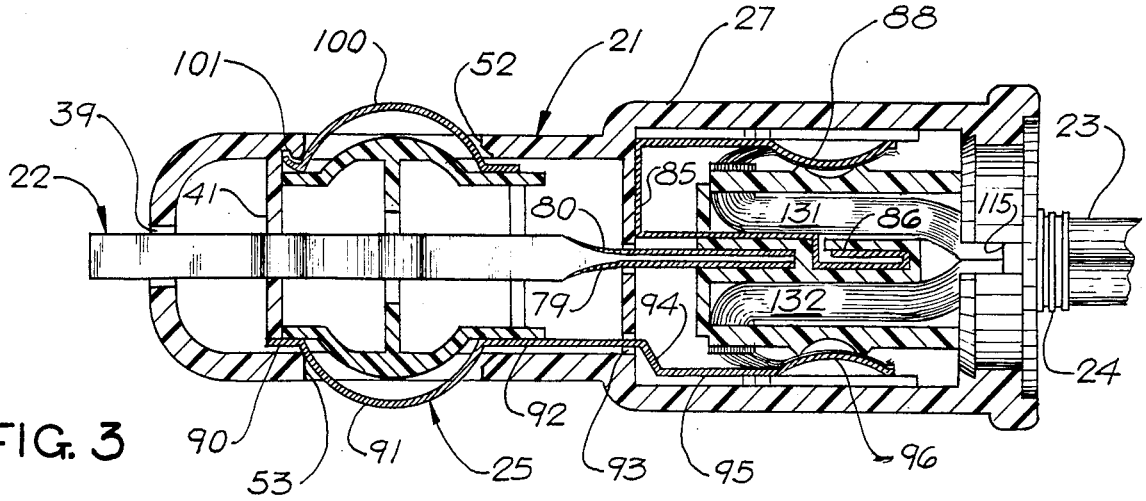
FIG. 3 is a cross-sectional view taken substantially along vantage line 3—3 of FIG. 2 and looking in the direction of the arrows thereon.

Having described the general makeup of the two half shell portions 35 and 36 which go to form the housing for the plug assembly, a more detailed understanding of the assembly of such shells and the interior components of the plug assembly will be understood with reference to FIGS. 3 and 4 of the drawings.

With particular reference to those figures, it will be recognized that the positive conductor 22 constitutes a solid unitary member extending from the nose end of the plug to the afterbody hereof and more particularly to the labyrinth 50 receptive of the connector blades of the fuse member 30. Specifically, (see FIG. 4) the positive connector 22 preferrably comprises an elongated unitary strip of electrically conducive metal, such as copper or brass, bent to have parallel spaced arm portions 71 and 72 at its outer end interjoined by a transversely related leg portion 73. Such arm and leg portions are disposed coaxially of the opening 39 at the nose end of the assembled adapter plug housing to extend outwardly of the wall portions 38,38*a* thereat. Arm portion 72 extends rearwardly from leg 73 to merge with a first re-entrant bend 74 comprising a first coil of a integral spring system for the contact member 22 comprising the re-entrant bend portion 74, a second oppositely directed larger re-entrant bend portion 75 and a third bend portion 76 parallel to portion 74 and of like configuration therewith. The third bend portion 76 of the spring system merges into a rearwardly extending arm portion 78 which is folded downwardly to provide laterally spaced leaf members 79 and 80 which extend rearwardly to enter opening 81 the fuse receptive labyrinth 50. This relationship is best recognized from FIGS. 3 and 6 of the drawings. The main body of the contact member 22 constitutes an elongated rectangular flat metal band with the arm portions 79 and 80 thereof being disposed transversely of its general plane of formation. Importantly, the spaced relationship of portions 79 and 80 comprise fuse blade receptive contacts for receiving one blade of the fuse member therebetween.

In addition to the unitary contact member 22, the positive contact system includes an associated conductor member 85 which is coupled to the labyrinth 50 and comprises a flat metal band bent in an circuitous configuration of the order illustrated in FIG. 3 of the drawings. Member 85 provides a blade receptive portion 86 at one end which is insertedly received in the second opening 87 of the labyrinth 50 (see FIGS. 3 and 5). The opposite end of the conductor 85 is formed with a semicircular end to provide a spring portion 88 which slidably engages an adjacent one of the slide pads 51 formed on the inside side wall of the handle section 27, as best shown in FIG. 3. It will be appreciated that the coplanar blades of the fuse member 30 are inserted through the socket opening in the bottom of the exterior recess 28 of the housing (see FIG. 4) and enter the receptive terminal 86 and spaced terminal ends 79 and 80 of the positive contact member 22, thus bridging the conductor 85 and the contact member 22 to complete circuit connection therebetween via the fuse member 30.

From FIG. 3 it will be recognized that the negative contact member 25 also is assembled in the male half shell portion 35 prior to a mating of the two half shells; the same being disposed along one side of the plug assembly to cooperate with the lateral opening formed by shell opening portions 53 and 53*a* or the assembled housing. More specifically, the negative contact member comprises, from its outer of left-hand end as viewed in FIG. 3, a linear finger portion 90 integral with a curvilinear spring portion 91 which substantially bridges the opening formed by portions 53,53*a* outwardly of an adjacent support 55. Spring portion 91 merges integrally with an elongated linear leg portion 92, coplanar with finger portion 90 and which, in assembly, passes through a passageway 93 in partition wall 57 of the male housing shell portion whereat the same is bent outwardly to form an angulated arm 94, integral with a second arm portion 95 paralleling leg 92. Arm 95 terminates in a curvilinear bowed spring portion 96 disposed over the second slide pad member 51 opposite the arcuate spring portion 87 of the positive conductor member 85. The outer finger portion 90 of the negative conductor moves through wall 41 or the male shell via a small opening 97 (see FIG. 5). This permits sliding movement of the negative conductor when the spring portion 91 thereof is compressed upon insertion into a cylindrical receptacle, such as a cigarette lighter receptacle. It will be appreciated that like the positive conductor portion 22 previously described, the negative conductor member 25 is unitary and made of a flat strip of electrical conductive material, such as copper or brass.

Mounted opposite spring portion 91 of the negative conductor 25 is the retention spring member 26 having a curvilinear or bowed body portion 100 which protrudes laterally outwardly through opening portions **52,52*a* in the two half shell portions, as previously noted. The outermost end of the curvilinear spring portion 100 is re-entrantly bent as at 101 to cooperate with a detent recess 102 and its counter-part 102*a* in the housing shell portions thereby anchoring one end of the spring means 26 over the underlying arcuate support wall 55. The opposite end of the spring body 100 extends linearly to slide over its support 55** during its compression upon entry into a female receptacle.

Spring means 26 cooperates with the spring portion 91 of the negative contact member to retain the male adapted plug in a female socket. In this latter, regard it will be noted that the provision of the two spring portions 91 and 100 accomodate the utilization of an adapter plug in accordance with this invention to receptacle sockets of varying diameter, assurring a positive fit and good negative contact with the receptacle.

It will be understood that energization of the positive contact 22 and negative contact 25 is from the power system of the automotive vehicle or other source associated with the female receptacle in which the male plug is inserted. In order to utilize the adaptor plug to energize a remote electrical appliance, the multi-wire conductor 23 is attached in circuit with the positive contact 22 and negative contact 25 as will now be described.

To better understand the means for joining conductor 23 to the contacts of the male adaptor plug, reference is made to FIGS. 7 through 9 of the drawings which illustrate the general features of a connector plug or cap 110 adapted to be inserted into the open outer end of the assembled adaptor plug. In brief, cap 110 comprises a cylindrical cover wall portion 111 at its outer end from which extends a coaxial smaller diametered locking portion 112 comprising a generally cylindrical body separated into four arcuate segments by intervening slotted openings 113. 114, and 115. It will be noted that the width of openings 113, 114, and 115 are shown unlike although this is not essential to the general workability of a cap of this nature. Further, it will be appreciated that assuming opening 113 is at the upper side of the cap as viewed in FIG. 4, two like opposed openings 114 (only one shown) are disposed in opposite sides of the locking portion 112 with opening 115 located at the bottom thereof. In any event, such openings 113–115 separate the locking portion 112 into four arcuate segments such that the segments between openings 113 and 114 are of lesser arcuate extent than those between the openings 114 and 115. The inner end of the cylindrical locking portion 112 is distinguished by a detent lip generally designated 116 which also is interrupted into four arcuate segments by openings 113–115. The several detent segments are adapted to enter the recessed areas 56 and **56*a* of the male and female shell portions when the cap member 110** is inserted into the assembled adaptor plug housing.

Extending coaxially outwardly of the locking portion 112 are two arcuate cross-sectioned arms 120,121 of like configuration. Each arm has an exterior partial cylindrical surface formed with pairs of outwardly projecting parallel spaced prongs 122,123 (on arms 120 and 121 respectively). The prongs 122 and 123 are formed alike and arranged in like fashion on each of the arms 120,121; the same being axially spaced along the exterior of their associated arm portions and joined by an intervening arcuate depression 124 and 125 respectively (see FIGS. 7 and 9). Prongs 122 and 123 are arranged to engage the curvilinear spring portions 87 and 93 of the positive contact conductor B5 and the negative conductor 25, respectively, in assembly. The axially inner ends of each of the arms 120,121 are distinguished by inwardly extending notched openings 126 aligned with the extending prong portions 122 and 123 (see FIG. 8).

It will be understood that portion 111 of the cap member 110 is adapted to be molded about conductor 23 along with the strain relief 24 so as to integrate the conductor with the cap member 110. Two conductor wires 131 and 132 (see FIG. 3) of the conductor 23 extend within the hollow interior of the closure member 110 along the inside walls of the arm portions 121,121 and are anchored in position by engagement with the sloted openings 126 in the outer ends of such arm portions, After passing through the notched openings a bared wire end of each of the conductor wires is positioned over and between the projecting prongs 122 and 123 on the exterior of the two arms 120 and 121. So assembled, the cap member 110 is inserted into the open end (**40,40*a*) of the adaptor plug body and pressed into place, causing the bare wire ends of the respective conductors 131 and 132 to move beneath the spring portions 87 and 96 of the positive and negative contact members adjacent opposite sides of the plug handle section 27. This clamps the wires positively in place across projections 122 and 123 to hold the bared wire ends against the arcuate spring portions 87 and 96 to insure good electrical contact with the positive and negative conductors of the plug assembly. Inserting movement of the cap member is continued until the detent lips 116 thereof lock into the recessed areas 56 and 56*a* of the shell portions, thus positively locking cap member 110** in position and enclosing the outer end of the adaptor plug in a fashion which does not readily lend itself to removal of the cap member from the unified plug body. Thus, the assembly of the adaptor plug is secure from outside interference and meddling with its interior componentry.

In operation, as previously noted, insertion of an adaptor plug 20 of the order hereinabove described into a cylindrical receptacle, such as a cigarette lighter receptacle, results in inward radial compression of the spring portions 91 and 100 associated with the negative contact system. This securely holds the adaptor plug in the receptacle, and accomodates the same to varying receptacle diameters. In addition, it is to be noted that positive circuit making engagement between the positive contact 22 and the corresponding contact of the receptacle is insured by virtue of the spring configuration and unitary construction of the positive contact means 22. More specifically, it will be recalled that the positive contact member 22 is configured with three interconnected spring loops which are adapted to be compressed under axial loads. In this latter respect, it will be recalled that the female shell section 36 presents a stop shoulder 70 to the opposing end of the positive contact portion 71. This limits compression of the spring coils 74, 75, and 76 to avoid breakage of the positive conductor. With this arrangement the compressive force of the spring means associated with the positive contact 22 insures positive contact and engagement with the central interior contact of a female lighter receptacle.

As previously noted, the positive conductor system of the plug assembly 20 includes the fuse member 30 which, as shown best in FIG. 3, comprises a pair of coplanar blade-type contact members 135 and 136 which are interjoined by a fuse link 137 internally of an insulated, transparent plastic body 138 molded about the terminal blades 136 and the fuse link 137. The body 138 is generally of rectangular parallelogram configuration that provides ready visibility to the fuse element 137 so that a user may observe the blown or integral condition of the fuse without removing the same from the adaptor plug. It also will be appreciated and understood that the terminal blades 135 and 136 are readily insertable in the socket formed in the exterior wall of the housing substantially centrally of depression 28 (see FIGS. 1, 2, and 3). Insertion of the blade terminals 135 and 136 is directly into the positive conductor system of the adaptor plug, one blade terminal fitting between the spaced arm portions 79 and 80 of the generally elongated unitary contact member 22 and the other fuse terminal 136 fitting into the terminal portion 86 of the secondary positive contact conductor 85. Inasmuch as the outer or upper ends of the blade terminals of the fuse are disposed exteriorly of the adaptor plug body, air circulates freely about the fuse and its connection with the plug assembly to avoid unwanted heat build-up which would damage the operating characteristics of the fuse link.

It is to be noted that with the above-described arrangement, the user of an adaptor plug assembly 20 may readily visually inspect the condition of the fuse means 30 without removing the same from the adaptor plug assembly and, for that matter, without removing or withdrawing the adaptor plug from the cigarette lighter receptacle. If the fuse is blown, the user may readily withdraw the blade-type fuse and replace it in the adaptor plug body. Again this operation may take place without removing the adaptor plug from the cigarette receptacle. This feature permits the user to semi-permanently secure or lash down the adaptor plug to the lighter receptacle in those instances where that is desired.

While the features of this invention have so far been described in association with a male adaptor plug assembly 20, its basic concepts are equally applicable to a female receptacle as will now be described.

FEMALE RECEPTACLE ASSEMBLY

With specific reference to FIGS. 10 through 13 of the drawings, the particulars of a modified female receptacle assembly employing an exteriorily available and visable ATO-type fuse will now be set forth.

Figure 10:
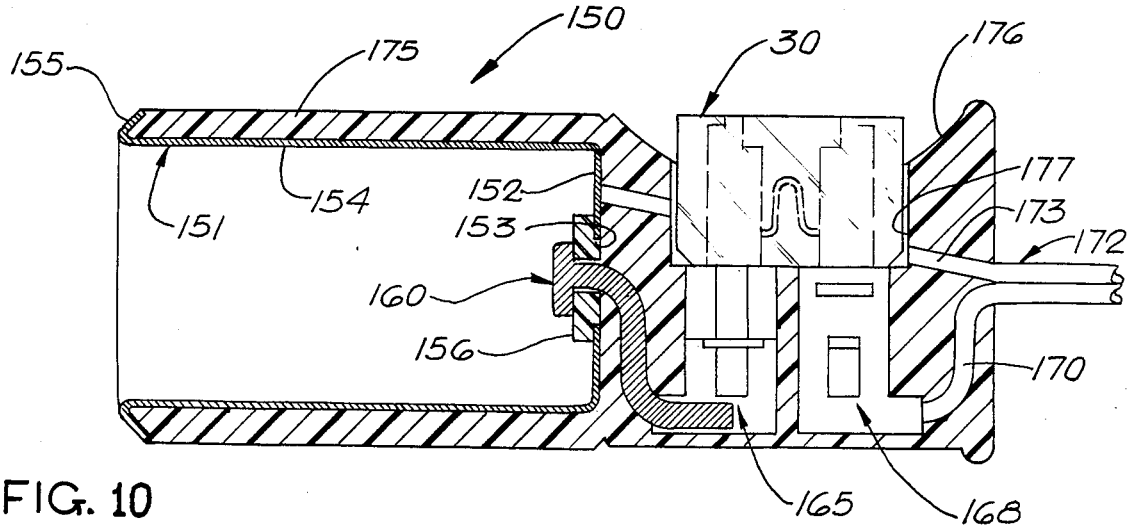
FIG. 10 is a longitudinal cross-sectional view taken through a modified female receptacle assembly in accordance with this invention.

As shown in FIG. 10, a female receptacle assemply 150 comprises a metal socket member 151 having one open outer end and a generally closed bottom 152 provided with a central opening 153. Cylindrical side walls 154 of the socket have the outer ends thereof reentrantly formed to provide a finished beaded configuration 155 thereon. The central opening in the bottom of the socket 151 receives an insulating washer 156 through which extends a unitary positive contact member 160, specifically illustrated in FIGS. 11 and 12 of the drawings.

With reference to the latter two figures, it will be noted that member 160 has an enlarged contact head 161 at one end of a conductor body having two right angular bends, thereby configured to comprise parallel arm portions 163 and 164, the former of which is integral with the contact head 161 and the latter which is adapted to be soldered to a terminal connector 165 preferably or the type illustrated in FIG. 13 of the drawings.

Terminal connector 165 is a commercially available type such as a 250 series receptacle made of brass or tin-plated brass and available from AMP, Inc., Harrisburg, Pa. The terminal 165 has an insert receptacle portion 166 at one end and a fastener portion 167 which is adapted to be crimped over the body of the extending arm portion 164 of the contact member 160 and secured thereto by soldering. The arrangement is such that the receptacle portion 166 of the connector is aligned in the same plane as the arms 163 and 164 of the contact member 160, and is disposed in an upright position as illustrated in FIG. 10 for receiving one of the connector blades of the insert fuse 30. A second terminal connector 168 is positioned adjacent connector 165 for insertion of the other blade terminal of the fuse; the terminal connectors 165,168 being aligned in coplanar position for reception of the laterally spaced coplanar blade terminals of the fuse. One wire 170 of the two wire conductor 171 leading to a energy supply source is joined to the second connector terminal 168 as illustrated in FIG. 10. So arranged, the inserted fuse 30 serves to bridge the two terminal connectors 165 and 168 to establish circuit between the supply conductor 171 and positive contact 160 of the receptacle assembly. The other wire 172 of the two wire conductor is joined, as by soldering, to the bottom wall 153 of the metal receptacle socket, which thereby functions as a negative contact for engagement with the negative contact of a adaptor plug.

In order to unify the components of the receptacle assembly 150, the socket member 151, contact member 160 terminal connectors 165,168 and conductor 171 are assembled in the manner illustrated in FIG. 10 within the cavity of an appropriate mold and are thereupon encapsulated within a body of a molten insulating material such as, rubber or plastic polyproplene. The molding configuration forms the outer insulated body 175 for the receptacle assembly including a depressed area 176 in the exterior thereof having a central socket 177 open to connectors 165,168 receptive of the insert blade of fuse 30. Such a molding operation totally unifies the assembly, locks the supply conductor 171 in place to restrain the same from transmitting forces to the interior components of the assembly and in general provides a unified assembly of near-indestructable characteristics. Due to possible shrinkage problems in the molding operation, it is fully contemplated, in accordance with experience, that initial pre-shot molding encapsulating the various components of the receptacle may be used followed by a final over molding to provide a finished uniform exterior for the assembly 150.

From the foregoing, it is believed that those familiar with the art will readily recognize the improved advancement thereof over previous known connector assemblies. It further is to be understood that while the invention has been described in association with a preferred embodiment illustrated in the drawings the same is subject to wide variation, modification and substitution of equivalents without departing from the spirit and scope of the invention which is intended to be unlimited by the foregoing except as may appear in the following appended claims.

The embodiments of the invention in which an exclusive property or privilege is claimed are defined as follows:

1. An electrical connector assembly comprising:

positive circuit contact means, negative circuit contact means, a pair of electrical conductors of an electrical card, coupling means associated with each of said contact means for connecting each thereof in circuit with a respective one of said conductors;

said coupling means associated with said positive contact means comprising a pair of separated, electrically isolated coplanar blade receptive terminal connector means, one of which is connected to said positive contact means and the other of which is connected to said one of said conductors associate with said positive contact means;

one-piece insert-type fuse means having a pair of laterally coplanar spaced blade contacts interconnected by a visably encapsulated, electrically insulated fuse link, said blade contacts being insertable into said spaced terminal connector means to establish fused circuit connection between said positive contact means and its associated said one of said conductors;

said coupling means associated with said negative contact means directly joining the same to its associated one of said conductors;

integral cylindrical housing means for enclosing said contact means, conductors, coupling means and terminal connector means to provide a unitary assembly;

said housing means being formed with a finger receptive exterior depression having an opening in the bottom thereof communicating with said terminal connector means and adapted to receive the blade contacts of said fuse means whereby the latter may be manually mounted in said terminal connector means so that said fuse link is visibly exposed on the exterior of said housing means.

2. The combination of claim 1 wherein said connector assembly is a female receptacle, said negative contact means comprises an electrically conductive cylindrical socket open at one end, and said positive contact means is mounted in the closed end of said socket and is electrically insulated therefrom.

3. The combination of claim 2 wherein said conductors are DC supply conductors comprising two separate wires, one of which is connected to said socket and the other of which is connected to one of said terminal connector means.

4. The connector assembly of claim 2 wherein said housing means is molded intimately about said socket, positive and negative contact means, terminal connector means, and conductors to hold the same in position.

5. The combination of claim 1, wherein said connector assembly is an elongated, generally cylindrical, male adaptor plug insertable into an electrically conductive female socket receptacle; said positive contact means being encased within said housing except for one end of a unitary member thereof which extends axially outwardly of one end of said housing means to engage a positive circuit contact mounted in the closed end of said female receptacle; the opposite end of said unitary member forming one of said terminal connector means receptive of one blade contact of said fuse means.

6. The combination of claim 5, wherein said negative contact means comprises a one piece member having an accurately bowed spring portion projecting laterally outwardly of said housing means for resiliently engaging and establishing circuit making contact with the interior of said female receptacle, and additional spring means anchored to said housing and having a bowed portion projecting laterally outwardly thereof opposite said first bowed portion to engage the interior walls of the receptacle, said two bowed portions serving to resiliently retain the adaptor plug within the female receptacle.

7. The combination of claim 5 wherein said housing means is formed with one open end, enclosure cap means carrying said individual conductors and adapted to be inserted into said open end to enclose the same, and detent means operative to removeably hold said cap means in said housing means.

8. The combination of claim 7 wherein said cap means is integrally molded about the conductors and joined to strain relief means for isolating assembled components within said housing means from external forces applied to said conductors.

9. The combination of claim 7 wherein said enclosure cap means comprises a unitary molded member having outwardly extending prong means arranged to engage bared end portions of said conductors when said cap means is mounted in said housing means, said prong means serving to lock said bared end portions against said positive and negative contact means to establish electrical circuit connection therewith.

10. The combination of claim 5, wherein said unitary member is formed with multiple re-entrant bends intermediate its ends to provide resilient spring means; said spring means opposing axial loads and being operative to positively hold said one end in spring loaded engagement with the positive circuit contact of said female receptacle.

* * * * *

UNITED STATES PATENT AND TRADEMARK OFFICE

CERTIFICATE OF CORRECTION

PATENT NO. : 4,789,361

DATED : December 6, 1988

INVENTOR(S) : Richard L. Kinzalow & Richard M. Kinzalow

It is certified that error appears in the above-identified patent and that said Letters Patent is hereby corrected as shown below:

Col. 1, line 50, "mat", should read "mate".

Col. 3, line 35, "on", should read "one".

Col. 8, line 16, "B5", should read "85".

Col. 9, line 63, "assemply", should read "assembly".

Col. 11, line 15 , "card", should read "cord".

Col. 11, line 24, "associate", should read "associated".

Signed and Sealed this

Ninth Day of May, 1989

*Attest:*

*Attesting Officer*

DONALD J. QUIGG

*Commissioner of Patents and Trademarks*